US005969729A

United States Patent [19]

Erickson et al.

[11] Patent Number: 5,969,729

[45] Date of Patent: Oct. 19, 1999

[54] INK JET PRINTER WITH ARTIFACT-REDUCING DRIVE CIRCUIT

[75] Inventors: Paul R. Erickson, Prior Lake; David H. Bennefeld, Ramsey; John P. Novotny, Burnsville, all of Minn.

[73] Assignee: Colorspan Corporation, Eden Prairie, Minn.

[21] Appl. No.: 08/425,107

[22] Filed: Apr. 20, 1995

Related U.S. Application Data

[63] Continuation-in-part of application No. 08/250,287, May 27, 1994.

[51] Int. Cl.[6] ..... B41J 29/38; B41J 29/393

[52] U.S. Cl. ..... 347/9; 347/19

[58] Field of Search ..... 347/19, 15, 12, 347/9, 11, 3; 358/298, 459

[56] References Cited

U.S. PATENT DOCUMENTS

| | | | |
|---|---|---|---|
| 4,032,978 | 6/1977 | Wong | 347/3 |
| 4,184,168 | 1/1980 | Isayama et al. | 347/9 |
| 4,228,440 | 10/1980 | Horike et al. | 347/83 |
| 4,245,224 | 1/1981 | Isayama et al. | 347/10 |
| 4,272,771 | 6/1981 | Furukawa | 347/12 |
| 4,403,223 | 9/1983 | Tsuzuki et al. | 347/68 |
| 4,491,851 | 1/1985 | Mizuno et al. | 347/11 |
| 4,513,299 | 4/1985 | Lee et al. | 347/15 |
| 4,561,025 | 12/1985 | Tsuzuki | 358/298 |
| 4,563,689 | 1/1986 | Murakami et al. | 347/11 |
| 4,631,548 | 12/1986 | Milbrandt | 347/15 |
| 4,636,808 | 1/1987 | Herron | 347/76 |
| 4,795,917 | 1/1989 | Scott et al. | 347/9 |
| 5,049,898 | 9/1991 | Arthur et al. | 347/19 |
| 5,067,032 | 11/1991 | Ida | 360/46 |
| 5,124,716 | 6/1992 | Roy et al. | 347/11 |
| 5,265,315 | 11/1993 | Hoisington et al. | 29/25.35 |

FOREIGN PATENT DOCUMENTS

| | | | |
|---|---|---|---|
| 3221459 | 9/1991 | Japan | 347/15 |

*Primary Examiner*—N. Le
*Assistant Examiner*—L. Anderson
*Attorney, Agent, or Firm*—Kinney & Lange; Paul H. McDowall

[57] ABSTRACT

An ink on demand type ink jet head energization system is provided to drive ink out of a nozzle in the head. The head contains at least one nozzle for discharging ink. The power applied to the nozzle is modified to include a noise component. By providing a driving voltage which varies between firings, the head produces ink droplets which differ in size between firings. Preferably, the voltage is randomly or pseudo-randomly varied over a range of from 50 to 100% of maximum voltage, and a new voltage is provided for each successive firing of the head. This variation of drive voltage produces ink dots which randomly vary in size at a rate too dense to be perceived by a viewer, and successfully reduces perceived artifacts in the printed output.

2 Claims, 6 Drawing Sheets

INK JET PRINTER WITH ARTIFACT-REDUCING DRIVE CIRCUIT

This is a continuation-in-part of pending application Ser. No. 08/250,287, filed May 27, 1994.

BACKGROUND OF THE INVENTION

This invention relates to an ink jet printer having a print head. More particularly, this invention relates to an energization system which alters the power applied to ink jets carried on the print head of an ink jet printer to reduce artifacts in the printed output.

Ink jet printing involves placing a number of tiny ink droplets formed by one or more ink jets onto particular locations on a printing medium (usually paper). The ink droplets solidify (or dry, or freeze) on the printing medium, forming small dots. A substantial number of these small dots, when viewed from some distance away, are perceived as a continuous visual image. Both text and graphic images may be printed with ink jet printing.

The printed image from an ink jet printer is made up of a gridlike pattern of potential dot locations, called picture elements or "pixels". For many documents commonly viewed from 1–20 feet away, the ink jet printing industry today often uses a print resolution of 300 pixels per inch (90,000 pixels per square inch). The print resolution for other applications may vary as needed, so for the example of printing a billboard that is commonly viewed from hundreds of feet away, the pixel sizes used may result in a density on the order of 6 pixels per inch.

Presently there are two primary types of initiators used to form ink jets for ink jet printers. Resistance heating based jets use a small resistor to heat a portion of ink and create a minute bubble within the ink. The bubble immediately bursts to propel a small droplet of ink through a nozzle. Piezoelectric displacement force based jets use a substrate which is electrically vibrated to create a pressure wave which in turn forces a droplet of ink through a jet nozzle. A method of making a piezoelectric initiator for an ink jet is taught in U.S. Pat. No. 5,265,315 to Hoisington et al., which is incorporated herein by reference. There are also ultrasonic ink jet heads and electrostatic ink jet heads available.

Ink jet printers may further be classified as "on demand", for which ink droplets are formed only at the particular pixel locations at which ink is desired to be placed, or as "continuous", for which ink droplets are formed for each pixel location, but droplets in flight for locations at which ink is not desired are deflected away before they contact the medium. In order to distribute an ink droplet in an on demand type ink jet head having piezoelectric transducers for forming the ink droplets, a high voltage pulse is applied to each piezoelectric transducer when its associated ink droplet is demanded. Each such transducer is part of a mechanical ink forcing arrangement comprising, in general, a piezoelectric crystal plate and a metallic diaphragm. When subjected to a high voltage pulse, the piezoelectric transducer is caused to deform against the diaphragm to pressurize ink in an ink chamber in communication with an ink jet nozzle or orifice, whereby the ink droplet is discharged through the nozzle. When the high voltage pulse is removed, the piezoelectric transducer returns to its initial shape so that a negative pressure is produced in the ink chamber and consequently further ink flows into the ink chamber from a supply source.

Additionally, the inks used in different kinds of ink jet printers vary. Some ink jet printers utilize aqueous ink, which are liquid at room temperature and are generally absorbed into the print medium. Others use "hot melt" ink, which is a solid at room temperature but is applied in a heated liquid condition to then effectively freeze onto the medium. The head assembly energization system of the present invention applies equally to all these various types of ink jet printers, but is particularly contemplated for on demand, piezoelectric, hot melt ink jet printing.

Color ink jet printers usually use the three subtractive primary colored inks, (magenta, cyan and yellow) in addition to black ink. Color blending of these four ink colors is achieved through two mechanisms. First, the ink jet printer may provide ink dots of multiple colors on the same pixel location, thus combining the subtractive effects of these colored inks on light reflected from that pixel. The particular color combination caused by having multiple ink colors at a particular pixel location may be affected by the order of printing the various colored inks.

Second, when viewed at a distance, the eye will perceive blended colors from pure primary colored ink dots provided at adjacent pixel locations. Thus, for instance, a number of exclusively magenta and yellow dots may be provided immediately adjacent to one another in an area of the image, with no pixel location receiving two overlapping inks. Rather than perceiving individual magenta and yellow dots, the eye will instead perceive a blend of the adjacent dot colors to result in the perception of a larger orange dot. In practice, ink jet color printers use both ink blending at particular pixel locations and perception blending across pixel locations to create various colors and shades. In addition, a substantial number of the pixels of the image will go without having a dot of ink placed on them. This allows the perceived visual image to have a proper lightness/darkness value. Through both forms of color blending, ink jet printers using only four colors of ink can visually reproduce full color images.

Ink jet printers generally move a print head containing ink jets back and forth across the printed image while advancing the paper lengthwise in between such passes, or scans, of the print head. To increase the rate of printing, numerous jets per color have been used to create a wider print head "swath", or wider inked surface strip per pass. One prior ink jet color printer utilized a single head having 64 linearly aligned jets. Each jet nozzle was vertically offset one pixel lower than the preceding nozzle. This line of 64 nozzles is divided into four sets of 16 adjacent nozzles, each such set being supplied with one of the colored inks. With this previous 64-jet printer in low quality printing mode, the paper being printed upon was advanced a length equal to 16 pixels after each scan (one quarter of the width of the 64 pixel print stroke), such that each scan of the printer head placed another set of 16 nozzles over the same path across a 16 pixel strip taken by the preceding set. This providing of four scans across a 16 pixel strip was done for each such strip printed on the medium.

Prior art scanning print head configurations, with numerous jets per color each mounted one pixel beneath the previous jet, predicate what is known as a "banding" problem and produces visible artifacts or errors in the printed output. One type of banding occurs if the paper advance is not extremely accurate, such that the paper is advanced slightly more or slightly less than the width of the print swath or stroke (i.e., the vertical extent of the line of jets). Thus, if the paper advances slightly too far a perceptible blank area will occur in the color pattern at the end of each paper advance, between the printed swaths. Conversely, if the paper advance is too short, a perceptible overlap will occur in the color pattern at the beginning of each paper advance, resulting in a darkened region where adjoining swaths overlap.

Other causes can further complicate the banding problem. With some printers, the direction that the print head is traveling for any given scan may affect the order that the different ink colors are laid down on the paper. A different ordering of colors may create a slightly different hue when visually perceived. For instance, if one band is laid down from left to right with magenta over cyan on a significant number of pixels, and the succeeding band is laid down from right to left with cyan over magenta on a significant number of pixels, a slight color difference between the two bands may be visually detectable.

Banding may also be caused in part by the thermal characteristics of the printing scan. In a hot melt ink system, the top of the band may be laid down first, on a relatively cool piece of paper, whereas the middle and bottom of the band may be laid down on a paper heated by previous ink dots. This difference in heating can affect the ink flow characteristics and cause a visually perceptible difference between the top and bottom of the band.

Banding is also caused by misalignment of ink jet heads in ink jet printers having multiple ink jet heads. These alignment problems become aggravated as the number of jets increase, as the spacing between the furthest jets increases during replacement of any other components of the print heads, and as the ink delivery and mechanical placement of print heads becomes more complicated. Alignment of multiple heads is not easily accomplished through mechanical manipulation of the jets, although compensation for some head alignment problems can be accomplished by adjusting the timing of jet firing between different jets. Calibration techniques can be used to determine what adjustment is necessary.

Banding may also be the result of differences in ink droplet size across a swath. For example, one end of the line of jets on the print head may produce slightly larger droplets than the other end, or the center of the line of jets may produce different sized ink droplets than the ends of the line of jets. The different droplet sizes may occur due to voltage drop across the head during firing. If the difference in ink droplet size occurs repeatedly during printing, artifacts between swaths may be visible in the printed output.

Other types of artifacts in the printed output can occur if the print head travel is not entirely uniform. Any vibration or displacement or change in velocity of the print head on a scan across the image may affect the dot placement location. Particularly in cases where the problem occurs regularly at the same location, the printed output will contain discreet artifacts which are perceived by the viewer.

Various methods have been attempted to compensate for these artifact problems. For instance, in U.S. Pat. No. 5,075,689 to Hoisington et al., banding was addressed by altering the arrangement of print jets out of a linear array. Another approach to banding, taught by U.S. Pat. No. 5,239,312 to Merna et al., involves altering the spacing between jets on a print head. Both of these previous methods involve additional manufacturing costs in aligning the ink jets into a non-uniform pattern.

Another approach is "multipass" printing, where the printing medium is advanced at a fractional increment of the vertical swath width, such that two or more jets of the same color pass over a pixel row on subsequent passes. The first jet will generally only print a portion of the dots on that pixel row, with remaining dots on the pixel row printed on subsequent passes. Alternatively or in combination, several of the jets may be deactivated on each pass. With only a portion of the jets actively printing on each pass, additional passes across the image are required for full printing. Multipass printing tends to mask paper advance errors such that they do not appear as discreet artifacts in the print output.

High voltage energization circuits for ink on demand type ink jet heads are known. These known circuits have been located away from the head and are connected to the transducers in the head by routing wires. The routing wires must be of a substantial length to accommodate the head travel across the width of the printing medium for printing. The high voltage energization circuits commonly used in the prior art transfer high voltage signals from the energization circuit to the ink jet head. There are a number of drawbacks to such known high voltage conversion circuits for ink jet heads. Above 42.4 volts peak, or 60 volts DC, power supply circuits fall into the "high voltage" category according to Underwriters Laboratory (UL) standards. *UL* 1950 *Information Technology Equipment,* Feb. 26, 1993, Section 1.2.8.4. If a signal is qualified as a high voltage signal, components such as covered connectors, wire shielding, access panel interlocks and the like are required to satisfy UL standards for safe design. These things all add unwanted restraining forces and inertia to the head and so to the mechanical drive requirements for the head assembly which must be capable of rapid movement to achieve high printing rates, and add substantial cost.

Radio frequency emissions are also a concern when routing high voltage signals from an energization circuit to an ink jet head. UL sets requirements for maximum acceptable limits on radio frequency emissions in view of the requirements of the Federal Communications Commission. Emissions higher than the acceptable limits must be reduced by shielding at a substantial cost when routing high voltage signals from an energization circuit to an ink jet head. Shielding adds additional restraining force as well.

SUMMARY OF THE INVENTION

The present invention includes an ink on demand type ink jet head. The head contains a plurality of nozzles for discharging ink droplets. A power supply provides the head with a voltage for firing the ink jets. The voltage of the power signal for firing of the head is not constant for each firing, but rather is varied between firings. By providing a driving voltage which varies between firings, the head produces ink droplets which differ in size between firings. Preferably, the voltage is randomly or pseudo-randomly varied over a range of from 50 to 100% of maximum optimal voltage, and a different voltage is provided for successive firings of the head. This variation of drive voltage produces ink dots which randomly or pseudo-randomly vary in size at a rate too dense to be perceived by a viewer, and successfully reduces perceived artifacts in the printed output. Other variations of drive voltage may similarly reduce perceived artifacts in the printed output.

DETAILED DESCRIPTION OF THE PREFERRED EMBODIMENTS

The present invention will be described in detail with particular reference to ink on demand, piezoelectric hot melt ink jet printing, but the invention can be used with any printing head requiring high voltage signals. Such a printer is described in U.S. patent application Ser. No. 08/425,120, filing date Apr. 20, 1995 now abandoned, entitled "HIGH SPEED INK JET PRINTER WITH HIGH QUALITY OUTPUT" filed on even date herewith by Lidke et al., assigned to the same assignee as the present invention and expressly incorporated herein by reference. The energization system of the present invention can also be used with ultrasonic ink jet heads or electrostatic ink jet heads. The present invention will also be described with particular reference to a head assembly carrying two printing heads on a mounting plate, but the invention can be used with a single head or with more than two heads carried on a mounting plate.

Figure 1:
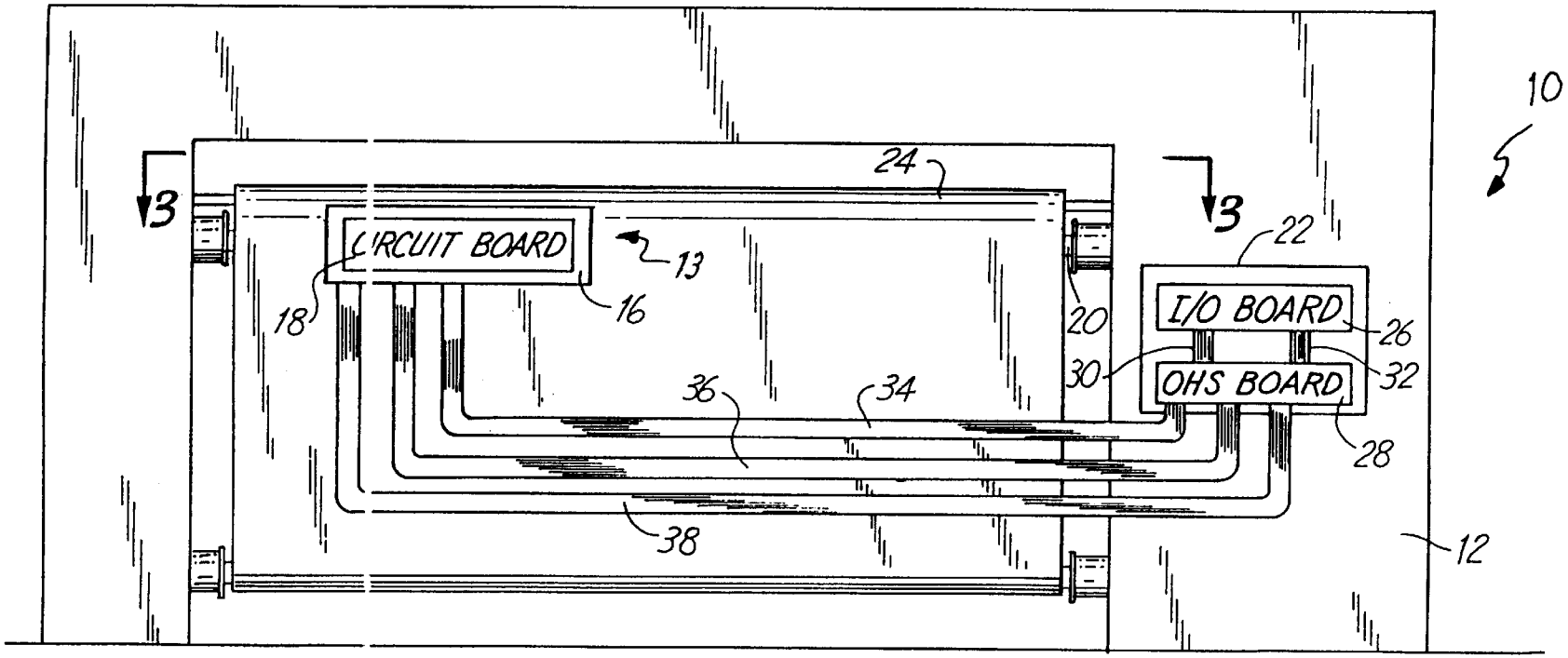
FIG. 1 illustrates a perspective view of an ink jet printer having a head assembly energization system carried on a print head assembly according to the present invention.

FIG. 1 illustrates an ink jet printer 10. The printer 10 includes a housing 12, an ink jet head assembly 13, a head assembly slide rail 14 (shown in FIG. 3), a print medium spool 20 and a control panel 22. The ink jet head assembly 13 includes a head mounting plate 16 and a head control circuit board 18 which is mounted onto the head mounting plate 16. The head mounting plate 16 is carried on the head assembly slide rail 14 such as with wheels in a track, to allow the head mounting plate 16 to travel along the length of the slide rail 14. The print medium spool 20 may hold a number of different printing mediums. In the preferred embodiment, the printing medium is a spool of paper 24.

As illustrated in FIG. 1, the control panel 22 is located away from the head assembly 13 and includes an input/output (I/O) board 26 and an off head supply (OHS) board 28. The I/O board 26 is connected to the OHS board 28 by a 60-pin head connector ribbon cable 30 and a 60-pin OHS connector ribbon cable 32. The OHS board 28 is connected to the head control board 18 by a 20-pin high voltage DC flex cable 34 and two 30-pin control flex cables 36 and 38, respectively, that are of sufficient length to reach the head assembly 13 throughout the full range of motion thereof across the entirety of the slide rail 14.

Figure 2:
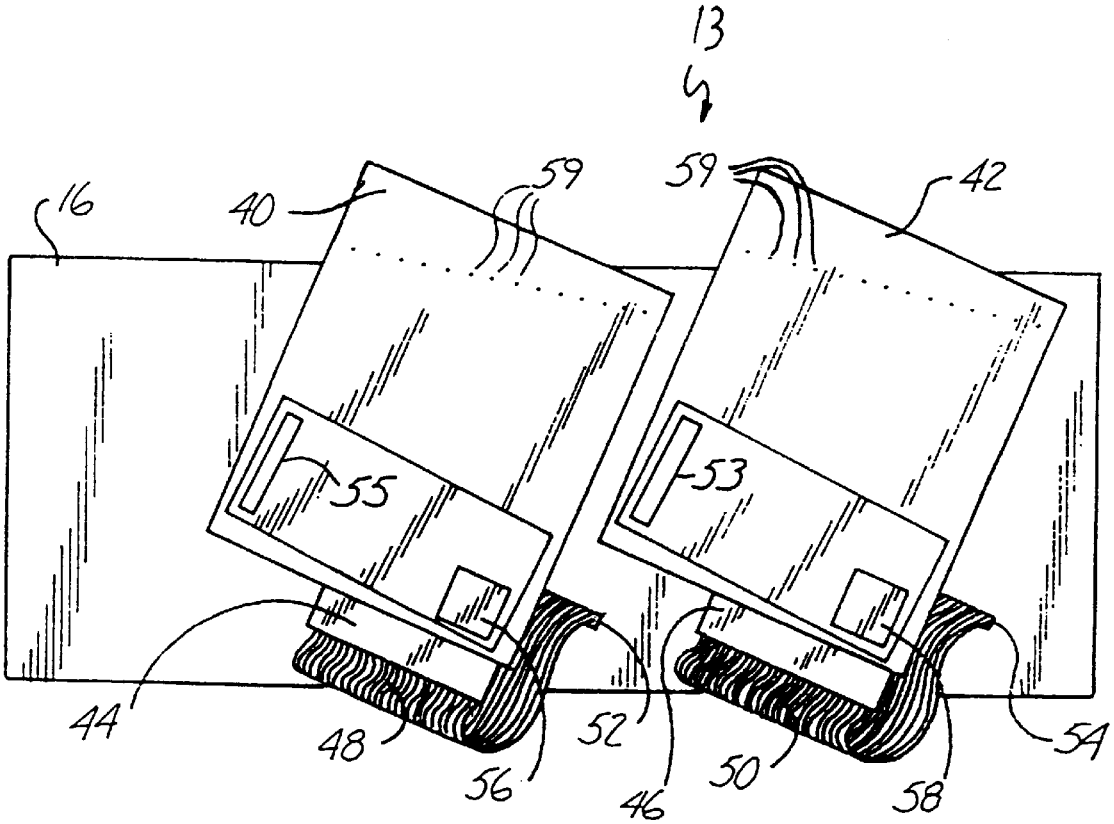
FIG. 2 is an enlarged perspective view of a pair of ink jet printing heads.

FIG. 2 is a view of the head assembly 13 from the paper spool 24 side of the assembly 13. As shown in FIG. 2, first and second printing heads 40 and 42 (Head1 and Head2), respectively, are mounted to the head mounting plate 16. Connectors 44 and 46 are mounted on the heads 40 and 42 for quick electrical connection and disconnection of the heads 40 and 42. A pair of 34-pin head connector ribbon cables 48 and 50, respectively, are provided to make electrical connection between the heads 40 and 42 and the head control circuit board 18 (FIG. 1). The head connector ribbon cables 48 and 50 must be of a type able to safely pass high voltage pulses in the range of 100 volts DC to 200 volts DC. As previously stated, signals above 42.4 volts peak, or 60 volts DC, are classified as high voltage under UL standards. Because the ribbon cables 48 and 50 are passing such high voltage pulses, it is desirous to keep the cables 48 and 50 as short as possible to minimize electromagnetic radiation therefrom. First and second slots 52 and 54 are provided substantially beneath the heads 40 and 42, respectively, to allow the ribbon cables 48 and 50 to pass through the head mounting plate 16 to connect to the head control circuit board 18 to the connectors 44 and 46 in as direct a route as possible.

The heads 40 and 42 are removably mounted onto the mounting plate 16 in a known manner, such as with bolts, to allow for quick replacement of the heads 40 and 42. The printing heads used in the preferred embodiment have an estimated print life of 100 kilograms of ink, after which the heads may need to be replaced. As previously stated, the heads of the preferred embodiment are piezoelectric type ink on demand heads. The heads 40 and 42 are formed of silicon and have 96 ink jet nozzles, or orifices 59, formed on each head using semiconductory lithographic and etching techniques, as illustrated in FIG. 2, each of which has an associated piezoelectric transducer. Shift registers 53 and 55 are provided on heads 40 and 42, respectively to receive a transducer selection data word from the I/O board 26. In the preferred embodiment, the registers 53 and 55 contain a position corresponding to each of the 96 transducers per head. Depending on the value contained in a transducer's corresponding position of the register, the transducer will either be set to discharge or not set to discharge at an appropriate time. This will be described in greater detail below.

As described in the Hoisington patent, previously incorporated by reference, each set of 96 piezoelectric transducers is formed on the same silicon wafer serving as a head from the same batch of PZT material. Each head may be formed out of a different batch of silicon, and as such, may have slightly different characteristics. Since each head may be slightly different, each head has its own unique optimum voltage level required to achieve an optimum ink drop size. For this reason the heads 40 and 42 each have a corresponding one of first and second EEPROMs 56 and 58, respectively, as shown schematically in FIG. 2. The EEPROMs 56 and 58 contain head specific information that is utilized for optimum printing in a manner to be described in greater detail below.

Figure 3:
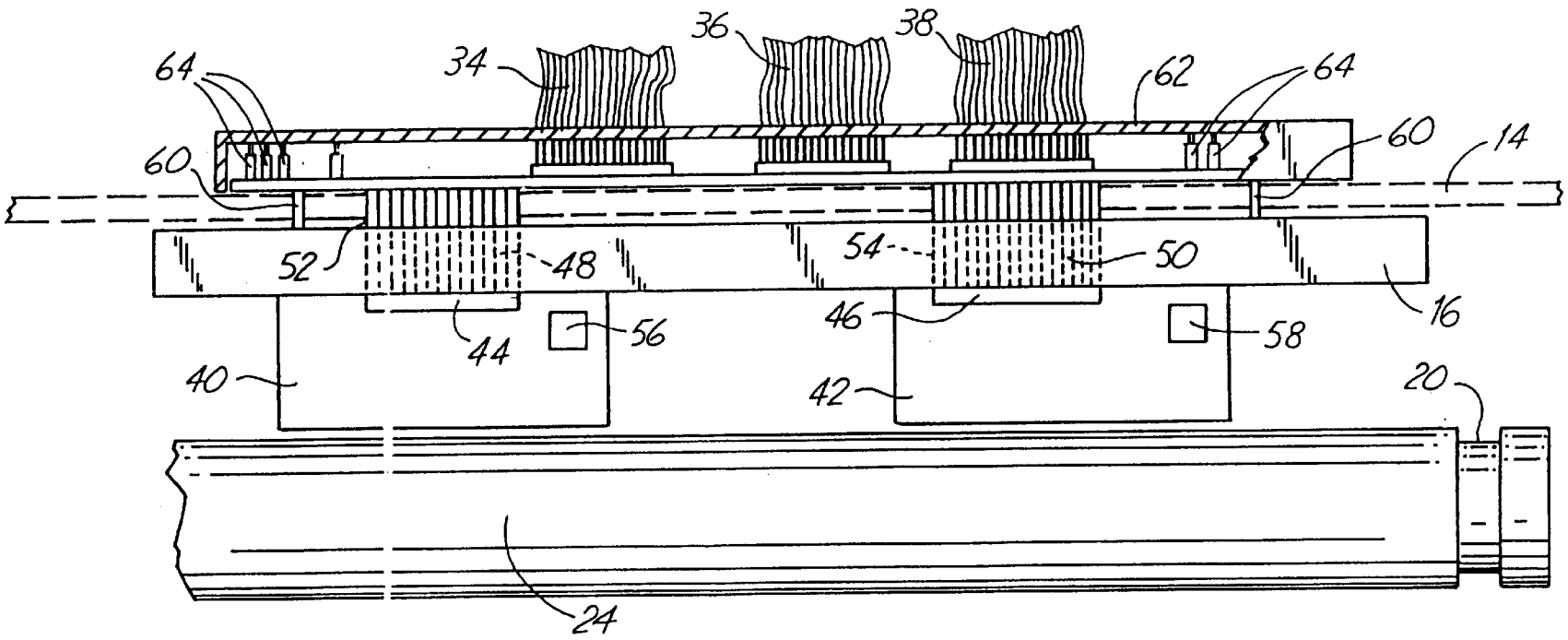
FIG. 3 is a sectional view taken along line 3—3 of FIG. 1.

FIG. 3 is a sectional view of the head assembly 13 taken along line 3—3 in FIG. 1. Stand offs 60 are provided to mount the head control board 18 a distance away from the head mounting plate 16. A heat diffusion cover plate 62 is mounted adjacent to the head control board 18 and is connected to the circuit board 18 through a plurality of transistors 64 on the head control circuit board 18. The transistors are packaged in a commonly used TO-220 package which provides an eyelet for mounting. The heat diffusion cover plate 62 acts as a heat sink to dissipate heat generated during the voltage conversion function, the amplification function and the switching function of the head control circuit board 18. The heat diffusion cover plate 62 also acts as a safety shield to prevent operators of the printer 10 from touching high voltage elements. In addition, the heat diffusion cover plate 62 also acts, to some extent, as an electromagnetic interference (EMI) suppression device.

Figure 4:
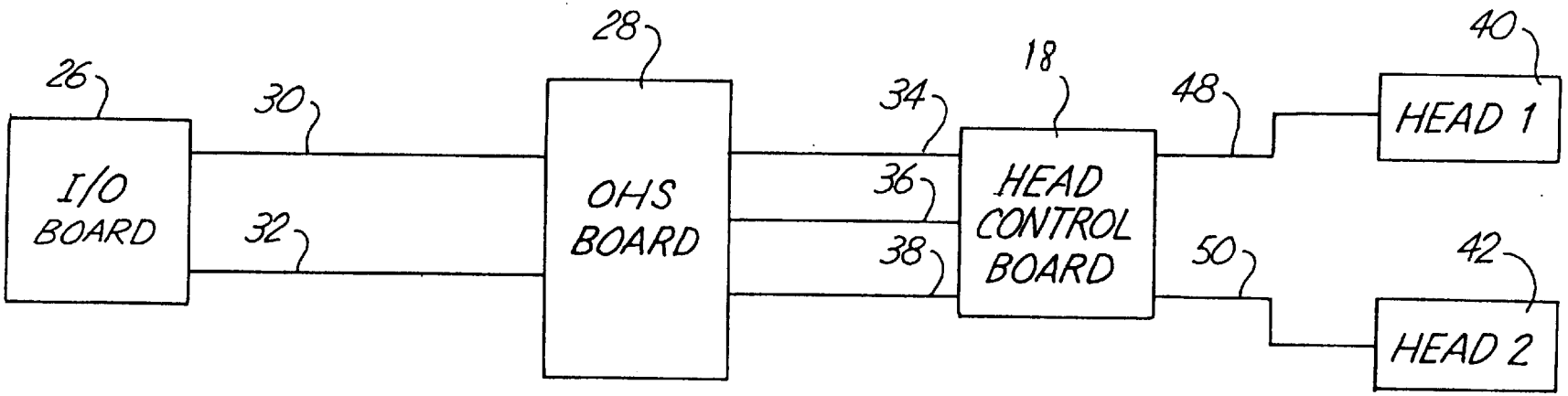
FIG. 4 is a block diagram of an I/O circuit board, an off head supply circuit board, a head control circuit board, and a pair of ink jet printing heads.

FIG. 4 is a block diagram illustrating the electrical interconnections between the I/O board 26, the OHS board 28, the head control board 18 and heads 40 and 42. As previously illustrated in FIG. 1, the I/O board 26 and the OHS board 28 are located off of the head assembly 13 while the head control board 18 is directly mounted to the head mounting plate 16. It is important to note that while flex cables or ribbon cables are used for connectors 30, 32, 34, 36, 38, 48, and 50, any type of multiconductor wiring could be used.

Figure 5:
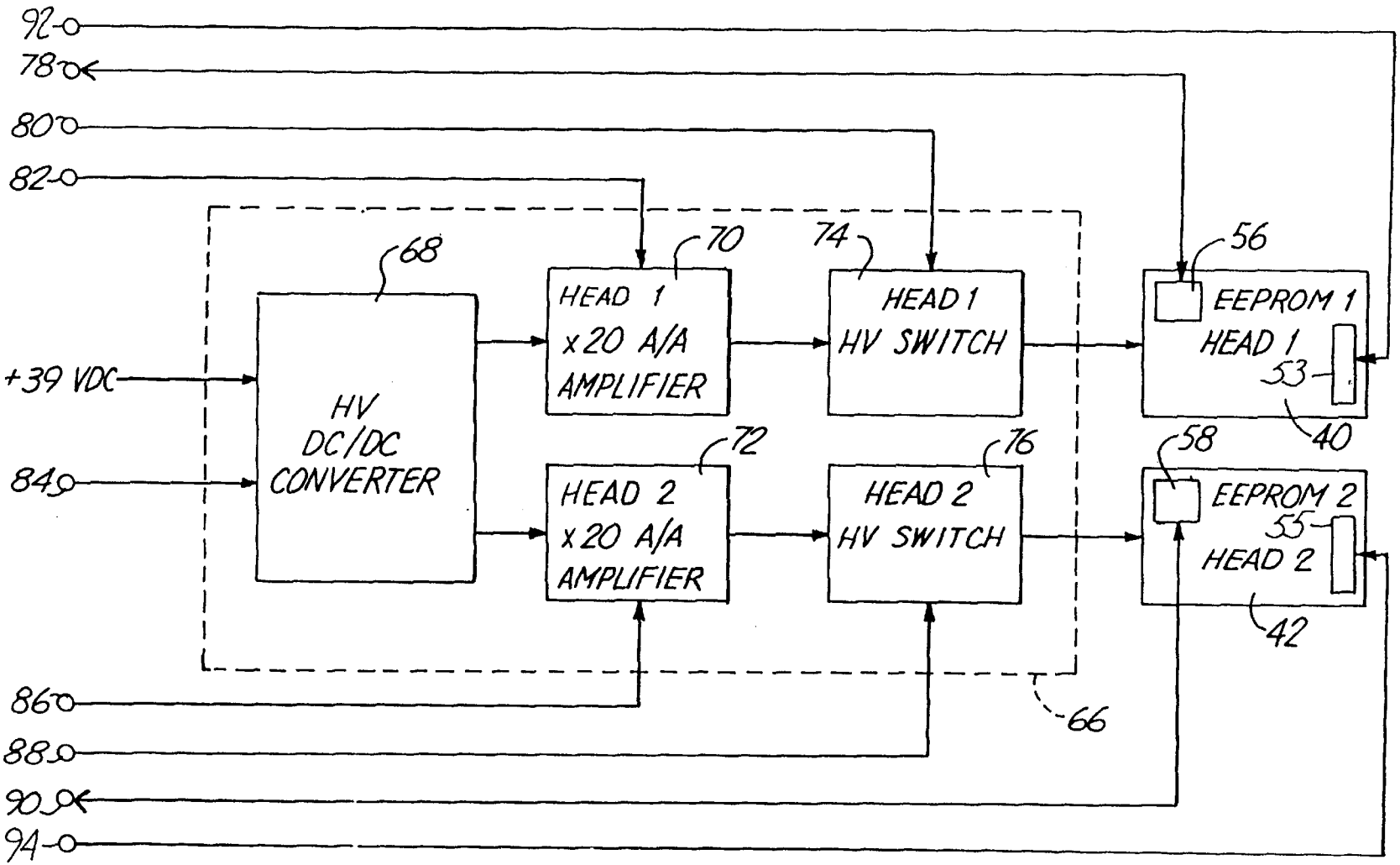
FIG. 5 is a block diagram of the head control board of FIG. 4.

FIG. 5 is a block diagram of the electronic system comprised of the components carried on the head mounting plate 16. A dashed-line box 66 illustrates the circuit stages contained on the head control circuit board 18. Inside the dashed box 66 is a high voltage DC to DC switching regulator 68 containing a DC to DC converter, a Head1 (X20) amplifier and voltage translator 70, a Head2 (X20) amplifier and voltage translator 72, a Head1 high voltage switch 74, and a Head2 high voltage switch 76. A connection junction 78 provided a connection between the first head 40 and the I/O board 26. This connection provides a control signal to the first EEPROM 56 from the I/O board and returns a signal concerning the optimal drive voltage to the I/O board as described above. A connection junction 80 provided a connection between the I/O board and the Head1 high voltage switch 74. This connection provides a switch initiation signal to the Head1 high voltage switch 74 from the I/O board indicating ink droplets are to be formed based on the image data. A connection junction 82 provided a connection between the I/O board and the Head1 amplifier 70. This connection provides a variable 0–10 volt signal to the Head1 amplifier 70. The variable 0–10 volt signal has a value dependent upon the optimal driving voltage value read from the first EEPROM 56 in a manner to be described in greater detail below.

A connection junction 84 provided a connection between the I/O board and the high voltage DC to DC switching converter 68. This connection provides a converter enable signal to the converter 68 from the I/O board 26. Connection junctions 86, 88 and 90 provide connections between the I/O board and the Head2 amplifier 72, the Head2 switch 76, and the second EEPROM 58, respectively. The connection junction 90 provides a connection between the second head 42 and the I/O board 26. This connection provides a control signal to the second EEPROM 58 from the I/O board and returns an optimal drive voltage signal to the I/O board.

The connection junction 88 provides a connection between the I/O board and the Head2 high voltage switch 76. This connection provides a switch initiation signal to the Head2 high voltage switch 76 from the I/O board directing ink droplet formation. The connection junction 86 provides a connection between the I/O board and the Head2 amplifier 72. This connection provides a variable 0–10 volt signal to the Head2 amplifier 72. The variable 0–10 volt signal has a value dependent upon the optimal driving voltage value read from the second EEPROM 58 in a manner to be described in greater detail below.

Connection junctions 92 and 94 provide a connection between the I/O board 26 and the shift registers 53 and 55 of heads 40 and 42, respectively. This connection provides a 96 bit transducer selection data word that selects which transducers are to form an ink droplet when an energization pulse, or a driving pulse, is sent to each head 40 and 42 in a manner to be described in greater detail below.

In operation, in order for the print heads 40 and 42 to eject a droplet of ink, a high voltage driving pulse is applied to each of the selected piezoelectric transducers associated with a nozzle from which ink is desired. If a high voltage pulse above a predetermined level is not applied to a transducer because it has not been selected, no ink will be discharged from the respective nozzle. As previously stated, each head contains an EEPROM which contains head specific information. The manufacturer's head specification sets forth criteria for specifying what actual driving voltage to use to obtain an optimal drop size for a particular head. This value is contained in the EEPROM. The nominal high voltage value is 160 volts DC but the actual high voltage needed to obtain an optimal drop size for a particular head may range between 100 volts to 200 volts DC. Thus, the optimal pulse voltage value for a head must be conditioned to match each specific head.

The I/O board 26 signals each head 40 and 42 to read out its voltage value for the optimal maximum driving pulse. This head specific voltage value is contained in the EEPROM 56 and 58, respectively. The optimal value will be in the previously described range of 100 to 200 volts DC. These values are returned from the EEPROMs 56 and 58 to the I/O board 26 where they may be manipulated as needed to obtain related analog low voltage signals in the range of 0–10 volts DC. The related analog low voltage signals (0–10 volts DC) are then supplied to the amplifiers 70 and 72 respectively through junctions 82 and 86. For example, if the optimal driving pulse peak voltage value for a specific head is 190 volts, the I/O board 26 will supply the amplifier with a corresponding peak low voltage signal of 9.5 volts. A low voltage signal is provided from the I/O board 26 because of the advantages set out above for transferring a low voltage signal from the control panel 22 where the I/O board 26 is located as opposed to transferring a high voltage signal from the control panel 22 to the head assembly 13. When the amplifiers 70 and 72 receive their respective low voltage signals from the I/O board 26, the amplifiers 70 and 72 multiply that voltage supplied thereto by 20 while translating the signal from occurring between a low voltage supply and ground to occurring between the negative high magnitude voltage developed by the converter 68 and ground, to provide a corresponding regulated output voltage of the proper transducer energization peak value to the switching circuits 74 and 76, respectively.

Thus, before the amplifiers 70 and 72 can multiply the low voltage signals, a 39 volt supply voltage must be converted into approximately a negative 230 volt value in the high voltage DC to DC switching regulator 68. This conversion takes place when a converter enable signal has been received from the I/O board by the regulator 68. The negative 230 volt voltage supply is used in the amplifier circuits 70 and 72 and in the switching circuits 74 and 76.

The regulated voltage outputs of the amplifier circuits 70 and 72 are provided to the high voltage switches 74 and 76, respectively, as illustrated in FIG. 5. The high voltage switches each have two inputs, the corresponding one of the regulated voltage outputs from the amplifiers 70 and 72, and a head switch initiation signal from the I/O board 26. The output of the switching circuits 74 and 76 to the corresponding one of the heads 40 and 42 is either the ground reference or the corresponding one of the negative high voltage pulses developed therefor by its corresponding amplifier, depending upon the state of the switch initiation signal from the I/O board 26. When the Head1 switch 74 receives a switch initiation signal from the I/O board 26, the regulated voltage received from the Head1 amplifier 70 is, in effect, provided to the first head 40 as the peak value of a Head1 driving pulse. The duration of the driving pulse is controlled by the length of time of the switch initiation signal, as received by the Head1 switch 74.

Similarly, when the Head2 switch 76 receives a switch initiation pulse from the I/O board 26, the regulated voltage received by the switch from the Head2 amplifier 72 is, in effect, provided to the second head 42 as the peak value of a Head2 driving pulse. The duration of the driving pulse is controlled by the length of time of the switch initiation pulse, as received by the Head2 switch 76. As previously described, the peak magnitude of the voltage pulse signal sent to each head 40 and 42 is independently controlled by the value carried in EEPROMs 56 and 58. By sending the switch initiation pulse from the I/O board 26, the timing of the discharge for the selected transducers in each head and the duration of discharge for the selected transducers in each head are independently controlled by software.

As previously stated, there are 96 ink droplet forming nozzles per head. Each set of nozzles in a head is operated by a mechanical ink forcing arrangement having therein a piezoelectric transducer that is controlled by a 96 bit data word of zeros and ones. Depending on the state of its corresponding bit in the data word, a transducer is either selected to discharge or not selected to discharge on issuance of the driving pulse. When the driving pulse is sent to the head, all the transducers associated with the nozzles of a head that are selected to discharge, will discharge at once.

By only transferring high voltage signals by the two 34-pin ribbon cables 48 and 50, the dragging force of moving heavily insulated and shielded cables and the resulting inertia is avoided. In the present invention, only the short ribbon cables 48 and 50 need be able to handle high voltage signals, while the rest of the cables may be of an ordinary signal handling type.

Figure 6:
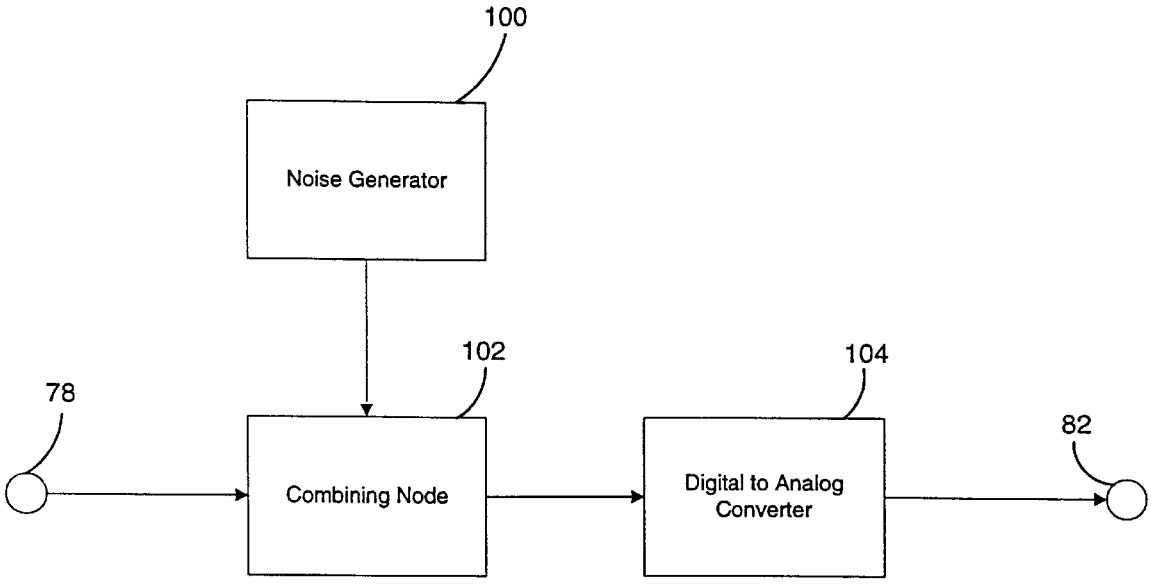
FIG. 6 is a block diagram of the noise circuit provided on the I/O circuit board.

FIG. 6 shows a preferred noise circuit. This noise circuit can exist on I/O circuit board 26 or elsewhere in the electrical circuitry for printer 10. While only one noise circuit is shown (for head1 40), additional noise circuits can be implemented for head2 42 and/or other print heads used in printer 10.

The noise circuit includes noise generator 100, which preferably creates a random or pseudo-random signal. For instance, noise generator 100 may randomly select a number between 1 and 128. Alternatively, noise generator 100 may create a noise pattern or other type of signal which is not based entirely on the image data. Workers skilled in the art may find that other patterns of noise signal from noise generator 100 may be beneficial toward reducing artifacts in the printed output.

In the most preferred embodiment, the signal from noise generator 100 is combined with the optimal drive voltage for the head 40. Connection junction 78, described also with reference to FIG. 5, represents a signal from the first EEPROM 56 concerning the optimal drive voltage for head 40. Combining node 102 combines the digital signal from noise generator 100 and the digital signal from EEPROM 56 at connection junction 78. Optimally, combining node 102 creates a digital signal which varies along a range from a minimal value (e.g., 50% of the optimal drive voltage stored on EEPROM 56) to a maximum value (e.g., 100% of the optimal drive voltage). Workers skilled in the art will appreciate that other ranges may prove beneficial toward reducing artifacts in the printed output. For any given printer and print head, the most beneficial noise pattern and signal range may be determined empirically by reviewing how well the printed output masks artifacts. For example, in systems such as continuous ink jet printing in which electrically charged ink droplets are positioned on the media using deflection plates, the range of 10–100% or intermittent control of drop volumes may be preferred. It will also be appreciated that combining node 102 is merely necessary to modify the noise signal in accordance with the ideal drive voltage as recorded on EEPROM 56. In systems where no effort is made to provide an ideal drive voltage for the particular head, there will be no need for combining node 102, and noise generator 100 may be simply added anywhere along the power transmission circuit to head 40.

Digital to analog converter 104 preferably converts the signal from combining node 102 into a DC analog signal provided to connection junction 82. Converter 104 preferably includes a 10 volt DC power supply, so the voltage output from converter 104 varies between about 2.5 volts and 10.0 volts DC, depending on the optimum maximum voltage to drive the head (as supplied by EEPROM 56) and the variations of noise generator 100. It will be appreciated the digital to analog converter 104 is unnecessary if noise generator 100 and/or combining node 102 operate in an analog mode to produce an analog voltage signal representative of the optimal voltage for the head. Referring back to FIG. 5, the optimal noise signal of connection junction 82 may be applied to the drive voltage for head 40 through head1 (X20) amplifier and voltage translator 70.

In reference to the earlier example wherein the optimal driving pulse peak voltage value for head1 is 190 volts, the system operates as follows. EEPROM 56 returns a digital signal representative of the 190 volt value to connection junction 78. Noise generator 100 randomly or pseudo-randomly selects numbers from 1 to 128 to obtain three particular firings of head 40. For purposes of this example, noise generator 100 selects the numbers 18, 107 and 52. Combining node 102 combines this noise pattern with the ideal voltage and the preferred range. Thus, for an ideal voltage of 190 volts, a range of 50% (95–190 volts) and the given noise signals, combining node 102 produces digital signals representing 108, 174 and 134 volts, respectively. Digital to analog converter 104 creates a low voltage signal which changes from 5.4 to 8.7 to 6.7 volts, which is provided through connection junction 82 to head1 (X20) amplifier and voltage translator 70. Amplifier and voltage translator 70 applies this input to the power from high voltage DC to DC switching regulator 68 to produce an output which changes from 108 to 174 to 134 volts. Based on the image signal received from connection junction 80, head1 high voltage switch 74 applies the 108 volt signal to the jets which are activated for the first firing, the 174 volt signal to the jets which are activated for the second firing, and the 134 volt signal to the jets which are activated for the third firing. This process of applying a voltage having a different random or pseudo-random component for each firing of the head continues throughout printing, and the entire image is printed of dots having a size which varies with a random or pseudo-random component.

In a preferred embodiment, the signal provided from noise generator 100 changes at the same rate as dot printing, or about 16 kilohertz. This creates a power signal level which changes between each firing of head 40. Workers skilled in the art may find that it is not necessary for the power signal applied to head 40 to change between every firing of head 40. However, the power signal applied to head 40 should be varied often enough so as to not produce discernable differences between dot density in the printed output. How frequently the power signal must be varied may in part depend on the resolution of the printer. The purpose of the noise generation is to produce output with different sized dots, without having a dot size pattern which can be discerned by the viewer. The sizes of the dots should change often enough so there is no discrete separation of print density when perceived by a viewer. By having different sized dots making up the printed output, the artifact reduction circuit masks any small placement errors between blocks of otherwise uniformly sized dots in a uniform matrix configuration.

Workers skilled in the art will appreciate that the noise in the firing power for the head 40 may be provided in other locations in the circuit. For instance, noise could similarly be provided in the signal from connection junction 84 to the high voltage DC/DC switching regulator 68; in the signal from high voltage DC/DC switching regulator 68 to head1 (X20) amplifier and voltage translator 70; in the signal from head1 (X20) amplifier and voltage translator 70 to head1 high voltage switch 74; or in the signal from head1 high voltage switch 74 to head1 40. If the noise is introduced into the DC portions of the circuit, the noise generator preferably will be an analog noise generator. Additional alternative locations to add noise will exist in systems having their electronics configured differently. For instance, in systems wherein the output size of a printed dot is dependent upon the duration of the power signal applied to the head, the duration of the power signal may be modified to include a random or pseudo-random component.

Although the present invention has been described with reference to preferred embodiments, workers skilled in the art will recognize that changes may be made in form and detail without departing from the spirit and scope of the invention.

What is claimed is:

1. An ink jet printer, comprising:

at least two print heads fabricated of non-identical semiconductor material and each having a plurality of ink jets residing on an exterior surface thereof, wherein each of said at least two print heads possesses a set of different electrical properties from the other of said at least two print heads;

an EEPROM electrically coupled to one of said print heads, wherein said EEPROM is programmed to store an information set for each of said plurality of ink jets that are related to said set of different electrical properties of the one of said print heads;

a power supply source for receiving the information set for each of the plurality of ink jets from the EEPROM and applying an ideal jet driving power signal to said at least two print heads and thereby created a compensated firing signal for each of said plurality of ink jets which, if applied to said at least two print heads would generate an emitted series of ink droplets of an ink marking material of the same volume of the ink marking material from each of said plurality of ink jets;

an image signal source for selectively activating each of the plurality of ink jets for firing a portion of the plurality of ink jets based on a digital image data set; and an artifact reduction circuit electrically coupled to the ideal jet driving power signal to selectively alter the power signal in a pseudo-random manner for each of said at least two print heads;

wherein the artifact reduction circuit alters a voltage of an ideal jet driving power signal and wherein the artifact reduction circuit comprises a noise generator which creates a low voltage noise signal and the low voltage noise signal electrically coupled to the ideal jet driving power signal via an electrical amplifier.

2. An artifact reduction circuit for use in driving a plurality of ink emitting jets of an ink jet printer, the ink jet printer having at least two print heads fabricated from semiconductor material and each of said at least two print heads having a plurality of ink emitting jets, and wherein the ink jets of each said at least two print heads emit an ink marking material in response to a power signal supplied from a power supply source, the artifact reduction circuit comprising:

a pseudo-random noise generator to generate a noise signal; and means for applying the noise signal to a power supply to modify the power signal according to the noise signal;

a plurality of ink emitting jets disposed on an exterior surface of at least two print heads, wherein each of said plurality of ink emitting jets electrically couple to the power signal so the power signal causes an ink marking material to be expelled from said jets in a random distribution of liquid ink droplets containing different liquid volumes of the ink marking material;

wherein the means for applying the noise signal is an electrical circuit for modifying a duration of the power signal applied to said plurality of ink emitting jets of each of said at least two print heads.

* * * * *